United States Patent [19]

Eckhardt et al.

[11] Patent Number: 5,010,272

[45] Date of Patent: Apr. 23, 1991

[54] CEMENTLESS ELECTRIC LAMP - BASE COMBINATION

[75] Inventors: Fritz Eckhardt, Gerstetten; Peter Helbig, Sontheim; Walter Schoenherr, Giengen, all of Fed. Rep. of Germany

[73] Assignee: Patent Treuhand Gesellschaft für elektrische Gluhlampen mbH, Munich, Fed. Rep. of Germany

[21] Appl. No.: 482,289

[22] Filed: Feb. 20, 1990

[30] Foreign Application Priority Data

Feb. 24, 1989 [DE] Fed. Rep. of Germany ... 8902247[U]
Jun. 9, 1989 [DE] Fed. Rep. of Germany ... 8907108[U]

[51] Int. Cl.[5] ..... H01K 1/46
[52] U.S. Cl. ..... 313/579; 313/318
[58] Field of Search ..... 313/318, 579, 113

[56] References Cited

U.S. PATENT DOCUMENTS 4,396,860 8/1983 Hellwig et al. ..... 313/318
4,412,273 10/1983 Helbig et al. ..... 313/113 X
4,492,893 1/1985 Steiner et al. ..... 313/579 X
4,950,942 8/1990 Braun et al. ..... 313/318

FOREIGN PATENT DOCUMENTS 2093632 9/1982 United Kingdom .

*Primary Examiner*—Palmer C. DeMeo
*Attorney, Agent, or Firm*—Frishauf, Holtz, Goodman & Woodward

[57] ABSTRACT

To provide a compact structure in which a base core (17, 48) can be fitted into a metallic base sleeve (9, 40) to which a holding structure (4, 7, 34) of a halogen incandescent lamp can be attached, the base core or the sleeve are formed with interengaging rim - engagement surfaces, and the base sleeve, further, is formed with projecting tabs which engage over or into the base core, through slits and recesses formed therein, to hold the base core in position; the base sleeve is additionally formed with a positioning or locating ring or plate (10, 44) so that the lamp holding structure (4, 7, 34) can be welded to the base sleeve to accurately position the filament of the lamp with respect to the locating plate or ring so that the filament can be located with respect to the focal point of a reflector, the tabs permitting compensation for tolerances in the base core, which may be substantial when made of ceramic material. Ceramic, typically Steatite, base cores are highly temperature-resistant, important when the lamp is a halogen incandescent lamp.

21 Claims, 9 Drawing Sheets

CEMENTLESS ELECTRIC LAMP - BASE COMBINATION

Reference to related patent, assigned to the assignee of the present application, the disclosure of which is hereby incorporated by reference:

U.S. Pat. No. 4,412,273, Helbig et al.

Reference to related patent publication, assigned to the assignee of the present application:

British 2 093 632, Eckhardt and Schonherr.

FIELD OF THE INVENTION

The present invention relates to a cementless electric lamp and base combination, and more particularly to attaching a halogen incandescent lamp to a metallic base, in which the lamp is held in the base in secure position with respect to a reference plane, formed by the base, so that the lamp can be readily associated with an optical system, such as a reflector. The lamp - base combination is especially suitable for use in automotive headlights where the lamp must be accurately aligned with respect to the reflector, and retain its alignment in spite of vibration, shock and the like transferred to the lamp - reflector combination upon use of the vehicle in which it is installed.

BACKGROUND

Lamps, and particularly halogen incandescent lamps for use in automotive headlights, are described, for example, in the referenced U.S. Pat. No. 4,412,273, Helbig et al. In this structure, a two-part base is used. The base includes a base core of plastic. A metallic base sleeve is retained in reception elements of the base core. The base core is comparatively complex and it has been found to present manufacturing difficulties.

The referenced British patent, assigned to the assignee of the present application, describes an automotive headlight-type lamp with a two-part base, in which the base core is made of ceramic. The ceramic base core and the base sleeve are coupled together by riveting. Some play may be left and the structure requires the additional rivet and the riveting part. The optical quality of an automotive headlight, however, is based largely on the quality of the attachment of the lamp to its base. As little play as possible should be used, so that the lamp will not go out of adjustment with respect to the focal point of the reflector. Ceramic materials are difficult to manufacture to close tolerances and, hence, a rivet connection which is tight and meets tolerance requirements is difficult to make.

THE INVENTION

It is an object to provide a lamp - base combination in which the base is a two-part element, namely a metallic sleeve and a base core, which is simple to manufacture, simple to assemble, and which, upon assembly, provides for a connection without play, and which, however, is self-adjusting to compensate for tolerances of the base core.

Briefly, a hollow, essentially cylindrical base sleeve is coupled to an essentially cylindrical, apertured base core, shaped to fit within the hollow sleeve by a rim formed on either the base sleeve or the base core and cooperating with the other one of the elements; the base sleeve is formed with projecting tabs which extend, at least in part, transversely of the longitudinal axis of the lamp and over part of the end surface of the base core.

The rim and the projecting tabs are so arranged that they cooperate to position the base core in the base sleeve. The base core and the base sleeve, together, form an interlocked structure, in which the base core is locked in position without play.

The arrangement has the advantage that the connection between the base sleeve and the base core can be readily made, without requiring additional materials. High accuracy of adjustment with respect to the filament of the lamp is maintained, which is a requirement for high-quality use in lamps associated with optical systems, for example automotive headlamps. The connection, additionally, has the substantial advantage that it can compensate for tolerances in the base core without affecting the optical quality of the positioning of the lamp with respect to the base sleeve. The base sleeve, customarily, includes a locating plate to locate it, and hence the lamp, in predetermined position with respect to the optical system with which it may be arranged to cooperate.

Compensation for tolerances is simply obtained by bending the tabs of the base sleeve towards the base core. Thus, they can be fitted against the individual dimensions of the base core. The rim, formed on one of the base parts, that is, either the base core or the base sleeve, forms a fixed abutment of a predetermined level with respect to the other part of the base. The metallic base sleeve can readily and easily be made with minimum tolerances; the bending position of the tabs then compensates for tolerances in the base core.

In accordance with a particularly preferred embodiment, the tabs engage against the end surface of the base core. The holding of the base core is then obtained in the region of a 90° bend of the projecting tabs. The tabs may be flat against the end surface of the base core, which is a preferred embodiment, or the base core may be formed with internal recesses which permit the tabs to be bent in convex shape to prevent possible deformation of the right-angle bent tabs. An additional, further attachment or engagement surface is then formed in the region of the recesses so that the slightly bowed tabs cannot deflect outwardly.

The base core may be formed with a depression at the end surface thereof, for accepting the entire tab. This depression may extend towards an inner recess for a convexly bent tab.

The base core may be made of ceramic or of plastic material. The particular arrangement is, however, especially suitable for base cores made of ceramic, since ceramic parts usually have a substantially higher tolerance than plastic parts.

The tolerances of ceramic parts in base cores for automotive headlights may be in the order of about 0.4 mm, whereas similar plastic parts have a typical tolerance of only about 0.05 mm. Ceramic structural elements are sensitive to shock and vibration. Gentle clamping of ceramic elements in metal parts is of particularly importance in automotive applications. The attachment arrangement in accordance with the present invention which permits use of ceramics in optical systems has the advantage that release of vapors is substantially better than that of plastic materials, and the temperature at the base is lower by the better heat insulation of the ceramic material than of plastics.

Halogen incandescent lamps operate at extremely high temperatures and the heat from the lamp may transfer to the base. When using plastic base elements, the reflector may be subject to coating of emanations from the plastic, which coating must be removed by subsequent treatment, for example subsequent heat treatment, annealing, or washing. These steps can be eliminated when using ceramic base cores.

The simple connection system in accordance with the present invention provides sufficient room at the base so that flat connecting blades may be used as well as round connecting prongs. Additionally, the arrangement readily permits coating the entire assembly at the rear or outside with a waterproof cover so that a spray, or even waterproof connection can be obtained.

The lamp can be easily assembled to the base. For example, the base sleeve and the lamp, together with a lamp holder structure, are placed in an optical system, adjusted with respect to each other, and securely connected when the lamp and base sleeve have the appropriate relative position. The base core, already supplied with the contact terminal elements, is then fitted into the base sleeve from below. The projecting tabs from the base sleeve are then bent over or deformed.

The foregoing sequence of steps has the advantage that lamps, which are under continuous quality control and which do not meet the optical specifications, can be removed from a production line before the base core is assembled thereto. It is, then, possible to disassemble the lamps from the previous base sleeve, readjust the lamp, and reset it. Rejects of completed lamps, therefore, are effectively eliminated.

DRAWINGS

Figure 3A:
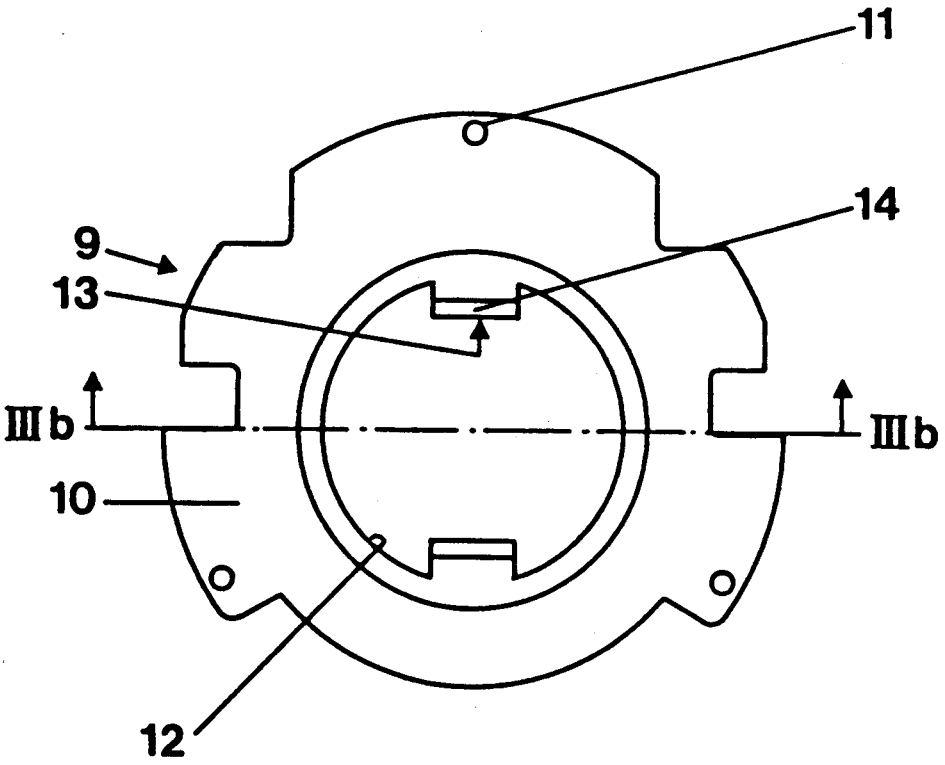
Figure 3B:
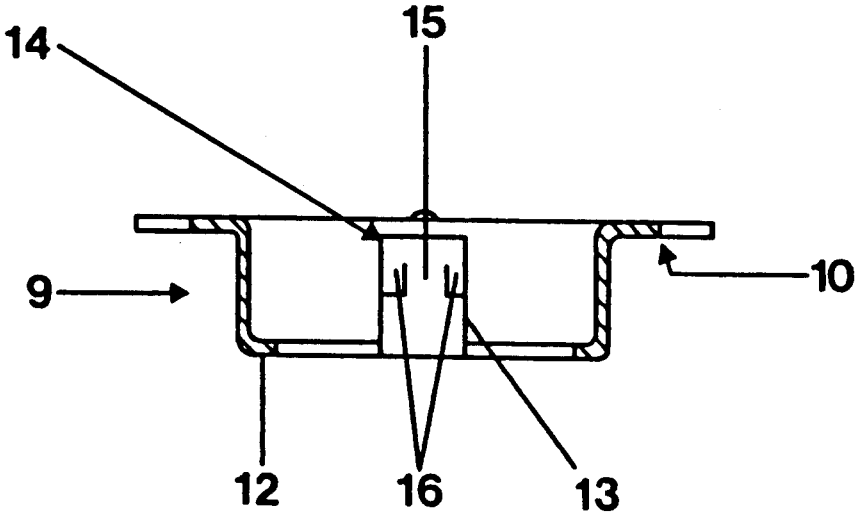

FIG. 3*a* is a top view of the base sleeve before assembly of the lamp;

FIG. 3*b* is a sectional view along line IIIb—IIIb of FIG. 3*a;*

Figure 4A:
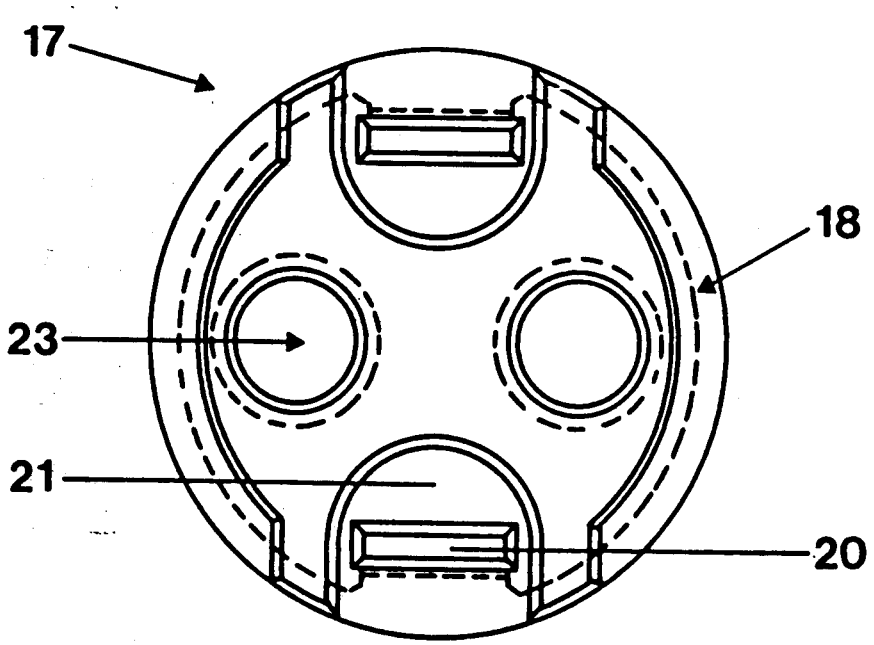
Figure 4B:
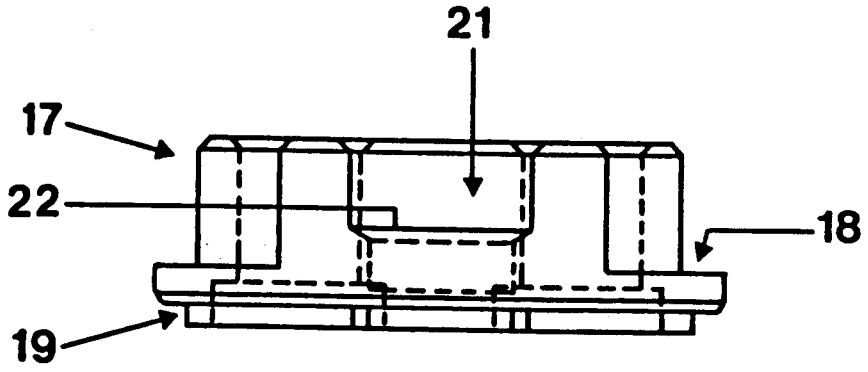
Figure 5:
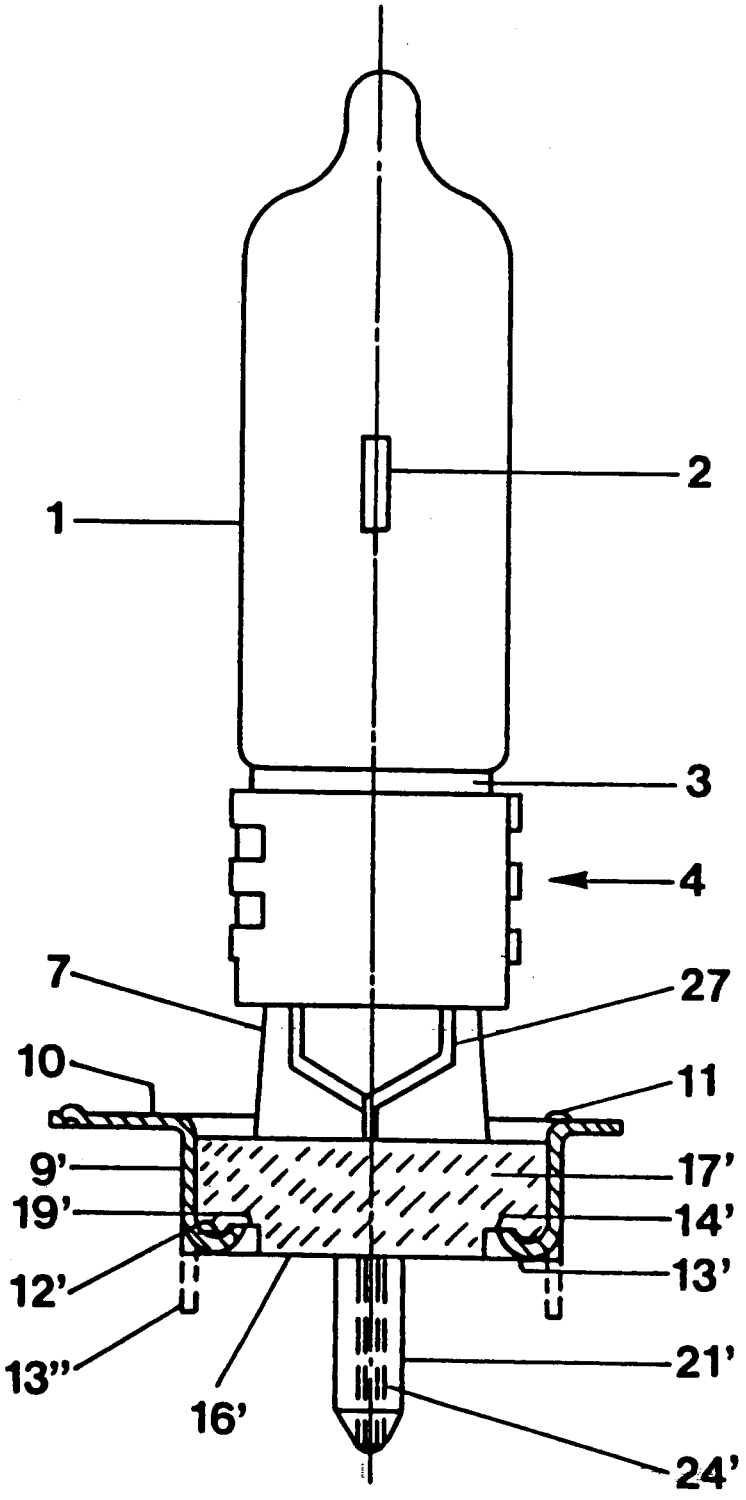
Figure 6:
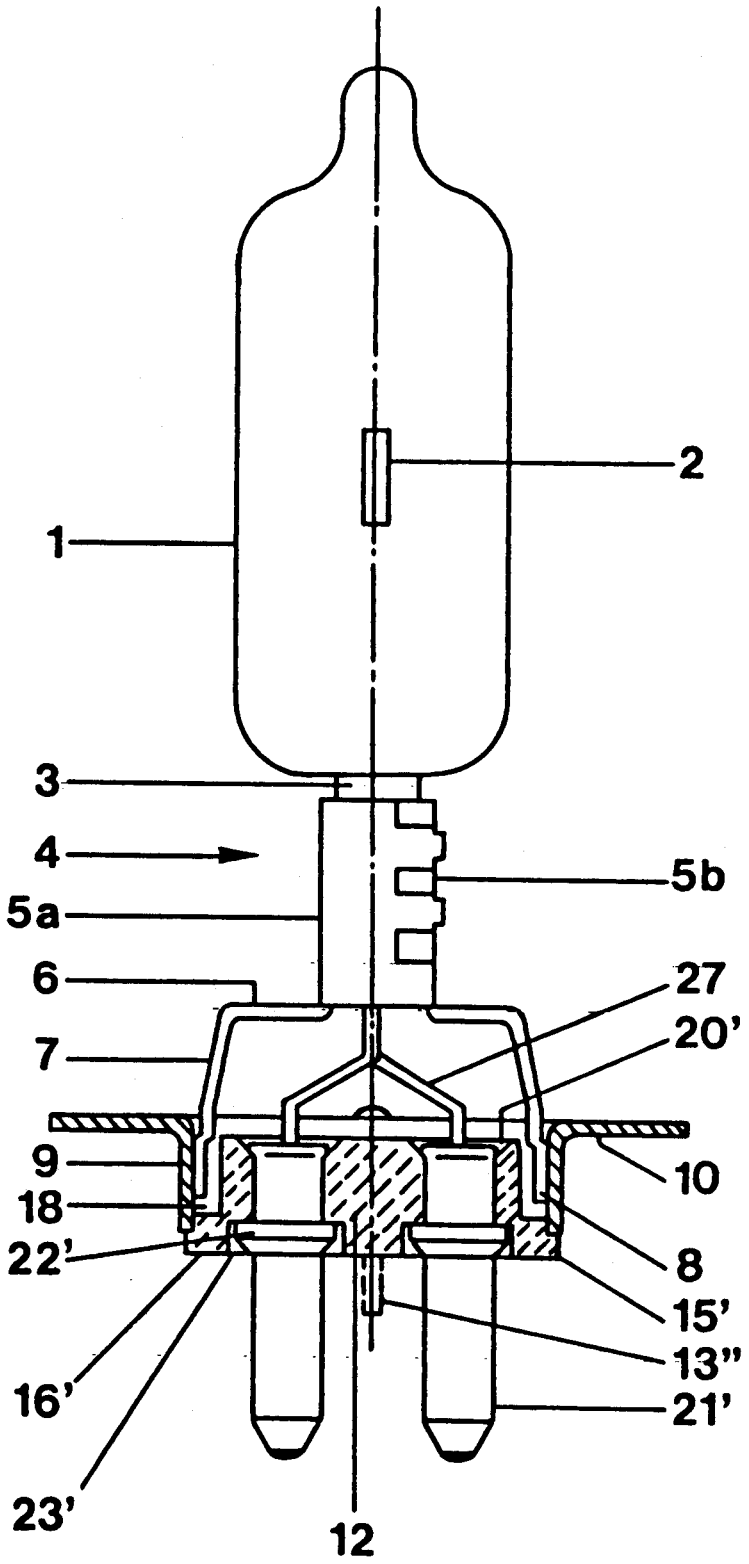
Figure 7:
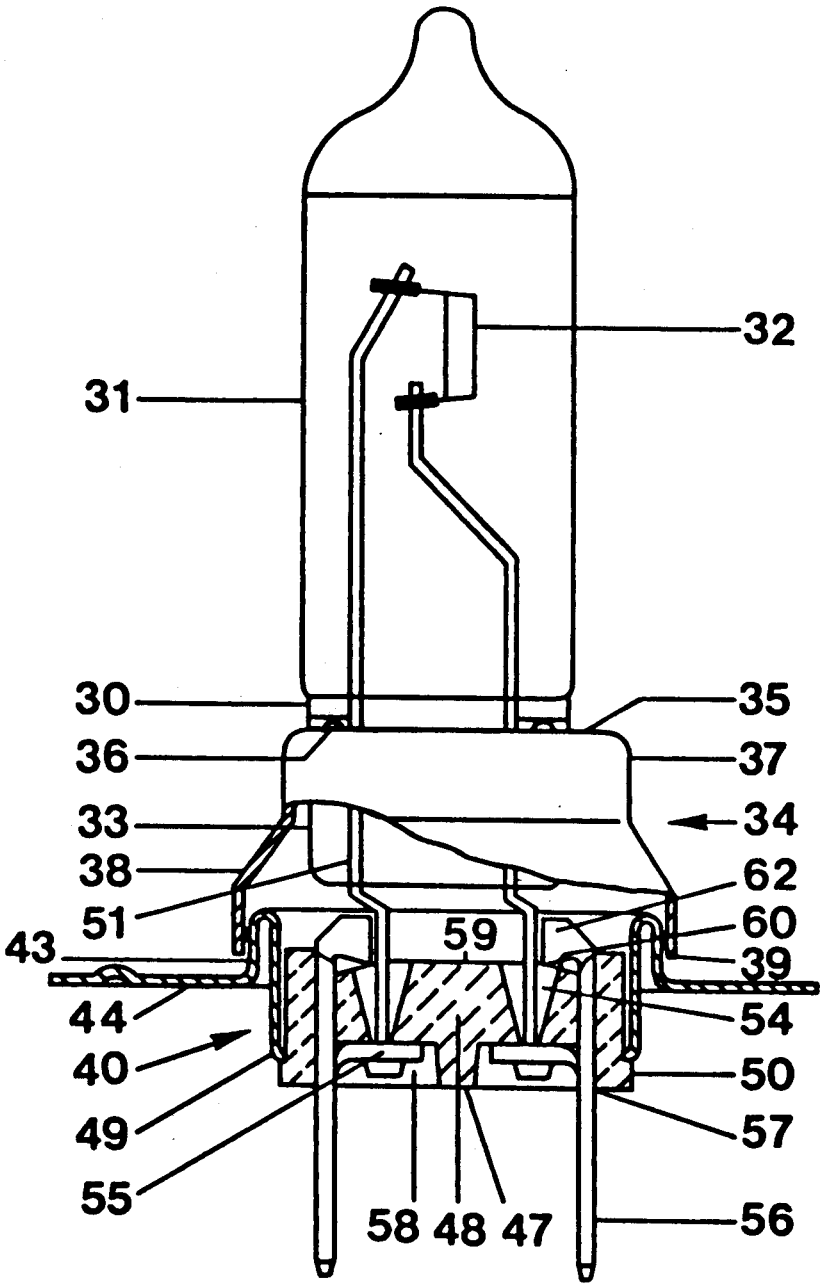
Figure 8:
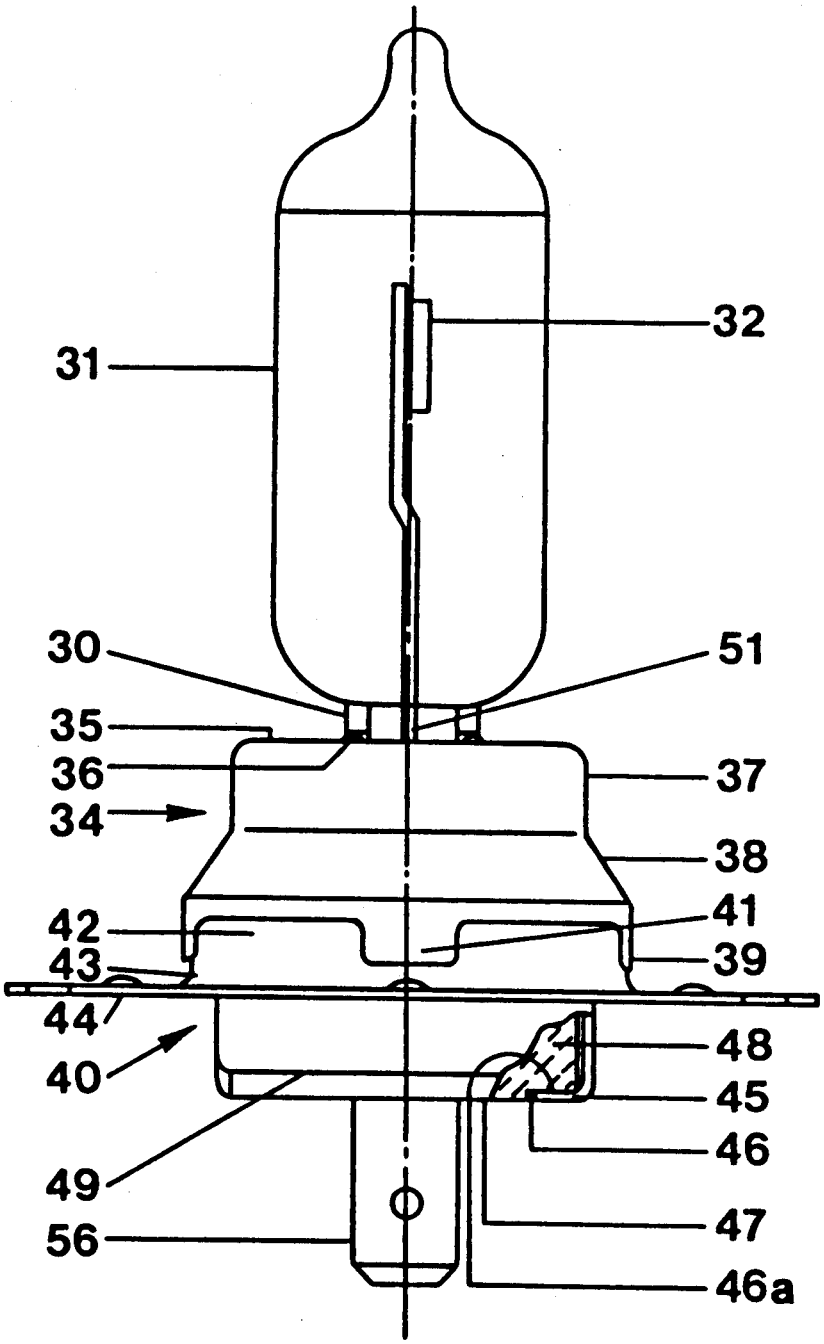
Figure 8A:
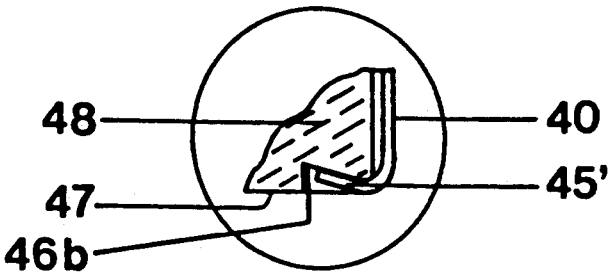
Figure 9B:
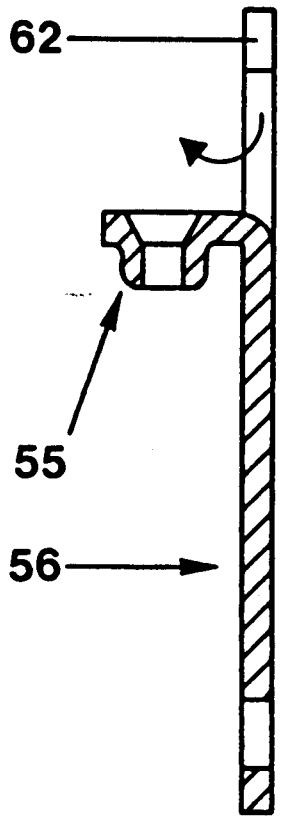
Figure 9A:
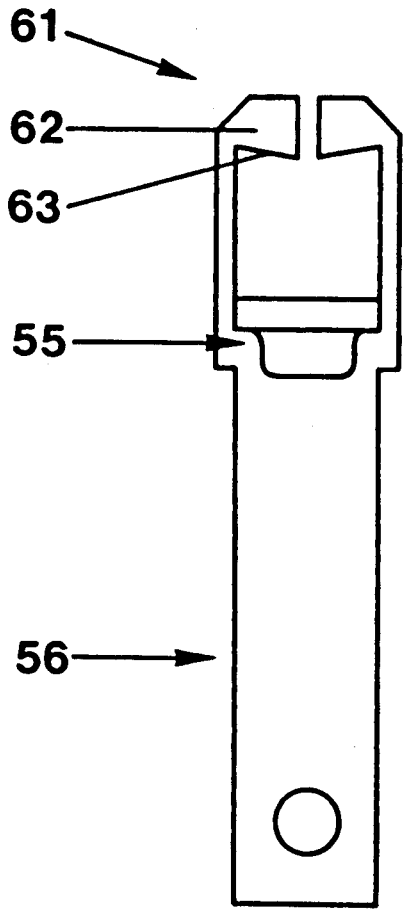

FIG. 4*a* is a top view of the base core, with the lamp omitted;

FIG. 4*b* is a side view of the base core;

FIG. 5 is a schematic side view of another embodiment of the lamp - base combination, in which the base is shown in section;

FIG. 6 is a view of the lamp of FIG. 5, rotated by 90°;

FIG. 7 is a schematic illustration of yet another lamp - base combination, with the lamp base mount partly cut away, and the base shown in section;

FIG. 8 is a side view of the lamp rotated 90° with respect to FIG. 7;

FIG. 8*a* is an enlarged detail view of another embodiment of an attachment of the base core;

FIG. 9*a* is a front view of a blade contact terminal for use in any one of the lamps, and especially of the lamps of FIGS. 7 and 8; and FIG. 9*b* is a vertical sectional view for the terminal of FIG. 9*a*.

DETAILED DESCRIPTION

Figure 1:
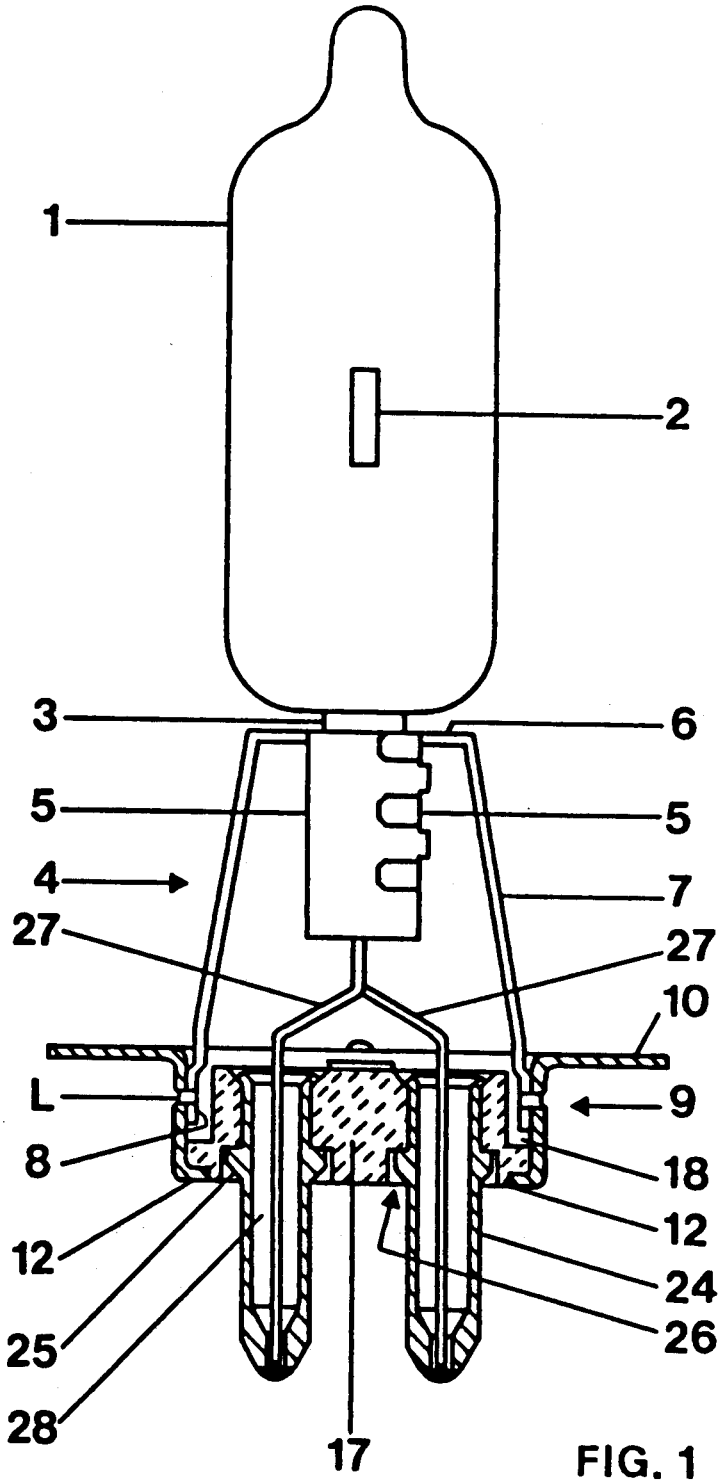
FIG. 1 is a schematic side view of a lamp - base combination in accordance with the present invention, in which the base is shown in cross section.
Figure 2:
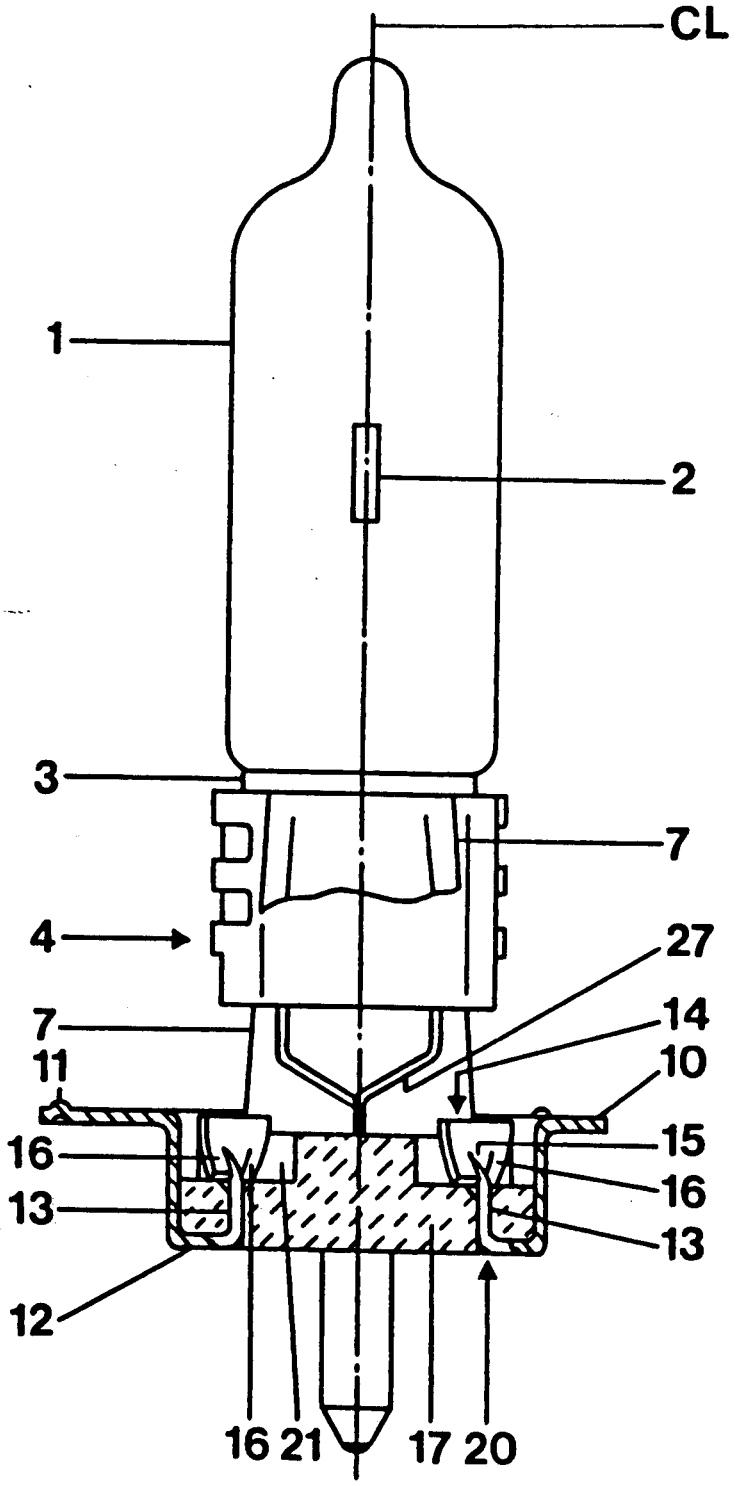
FIG. 2 is a view similar to FIG. 1, rotated by 90°.

Referring first to FIGS. 1 and 2: Lamp 1 is a halogen incandescent lamp of 50 W rating of the type H7 which, in some applications, replaces the prior type H1. These lamps are used as separate high-beam headlights in automotive applications.

The lamp has a cylindrical single-ended bulb of hard glass, terminating in a pinch or press seal 3. The cylindrical single-ended bulb 1 of hard glass is filled with inert gas and with a halogen additive; it includes an axial filament 2, supported by two current connection leads embedded in the pinch or press seal 3. The pinch or press seal 3 is surrounded by a holder element 4 of metal. The latter consists, as is known, of two halves 5. A projection 6 is formed thereon adjacent the bulb, the projection terminating in an apron-like support structure 7. The apron-like support 7 is bulged outwardly at an end 8. The end 8 engages in a metallic base sleeve 9. The base sleeve 9 is integral with a positioning ring or plate 10 which is used to provide for appropriate positioning against a reflector. It is formed with a plurality of recesses, cut-outs or notches, as well as bumps 11, see FIG. 3.

The apron-like extension 7 is secured to the base sleeve 9 by welding. Laser welding L is preferred, since laser welding has the advantage that, during the welding process, no torques are applied at the weld point and, therefore, the accuracy of adjustment of the lamp 1 with respect to the locating projection 10 is not impaired as the attachment weld is being made.

In accordance with a feature of the invention, the base sleeve 9 is formed with a rim 12 which is bent inwardly, in form of a collar. Rim 12 is located at the end of the base sleeve 9 remote from the bulb. The rim 12 as well as the locating plate or ring 10 are in a plane which is transverse to the axis or center line CL of the lamp.

In accordance with another feature of the invention, the base sleeve 9 is formed with two oppositely located projecting tabs, extending from the rim 12. The projecting tabs 13 are bent 90° with respect to the rim or collar 12, so that, with respect to the axis of the lamp, they are bent about 180°, to extend inwardly of a base core 17. The projecting tabs 13 terminate just short of the level of the positioning plate or ring 10. The end 14 of the respective projecting tab 13 is inversely forked to form a barb, or deformed in barb shape, to provide, for example, a central portion 15 and two outer barbs or tines 16 (see FIG. 3*b*). The outer tines or portions 16 are punched out from the end portion 14 and extend downwardly, or into the longitudinal extent of the end portion 14 of tab 13 up to about half the length of the inwardly bent portion, as seen in FIG. 3*b*.

The base core 17 is fitted into the base sleeve 9. It is made of ceramic material, for example Steatite. It is shaped, essentially, in form of a cylindrical body, with, as seen in FIG. 4, two part-circumferential recesses 18 (see FIG. 1), in order to provide room for the ends 8 of the apron-like part-conical portion 7 of the support structure 4 for lamp 1.

The base core 17 further is formed with a circumferential groove 19 at the end of the core 17 remote from the bulb to fit within the inwardly turned rim or collar 12, to form an essentially tight seat, without play, with respect to the rim or collar 12.

In accordance with a further feature of the invention, the base core 17 is formed with two elongated slits 20 into which the inwardly bent portions of the tabs 13 extend. The elongated slits terminate, adjacent the bulb 1, in two semi-circular recesses 21 (FIG. 4*a*), in which the tabs 13 end.

The base core 17 and the base sleeve are maintained in relative position by the rim 12 and the projection left adjacent the groove 19, and held in place by deformation of the ends 14 of the tabs 13. The tabs 13 are twisted, which reduces the effective length of the tabs. Since the thickness of the ceramic base core is subject to tolerances, the attachment of the base core to the base sleeve allows for compensation of such tolerances. By deforming the ends 14 of the tabs 13, any tolerances of the base core 17 will be compensated. The deformation of the tabs will always start at the bottom 22 of the semi-circular recess 21. This is important for compensation for tolerances. By forming the end 14 in forked shape, even better compensation for tolerances and better seating can be obtained, since the outer tines, upon twisting of the end portion 14 of the tab 13 will spread outwardly and the barbs will lock against the bottom 22 of the recess 21. Due to shortening of the effective length of the tabs 13, the spreading of the barbs is enhanced. Differences in dimensions of the base core, due to tolerances, from a nominal value, is compensated by different spreading angles of the barbs formed at the ends 14 of the tabs 13.

The base core 17 is formed with two axial bores 23 in which terminal elements 24 are inserted. The two terminal elements have their upper end expanded and they are formed, some distance from the upper end, by a ring bulge 25 (FIG. 1) which is seated in a recess 26 formed in the base core, to provide a counter abutment for the conically widened upper rim of the terminal prongs. The terminal prongs in form of rounded elements can he used since the attachment of the base core to the base sleeve is effected in space-saving manner by the flat tabs 13, which are deformed at their ends 14. For some applications, round terminal prongs 24 are preferred over flat blade terminals (see FIG. 9). The sockets which receive round terminals frequently can provide for better contact than sockets designed for flat blade terminals. Attachment of the current supply leads 27, also, is facilicated. The current supply leads 27, extending downwardly (FIG. 1) from the pinch seal 3, are angled off towards the contact pins 24, and threaded into the interior hollow space 28 thereof, and at the bottom end, are welded to the terminal pins or prongs 24.

Various modifications may be made within the inventive concept; the embodiment shown in FIG. 1 is merely an exemplary form.

The base core need not be made of ceramic; it may also be made of plastic. Heat transfer from the lamp to the plastic can be limited or shielded by providing two heat shields on the holding or support structure 4, for example shaped similar to butterfly wings. The somewhat semi-circular recesses 21 can be eliminated if the entire base core is made of lesser height or thickness.

The construction is particularly suitable for protection against sprayed water or other contamination. It is entirely possible to protect the base structure by coating the base remote from the lamp by a protective cover or coating, for example of plastic, which shields the entire base structure.

To produce the lamp, it is preferred to first insert the terminal pins 24, formed with the bulge 25, into the base core, and then widen the upper ends of the pins so that they are, in effect, riveted into the base core. Thereafter, the base core is inserted in the base sleeve from above. The tabs 13 can be pre-bent in the position shown, so that they can merely be threaded into the respective openings in the base core, to be then twisted and locked in position against the surface 22.

At the same time, and on for example a parallel production system or production line, the lamp 1 is attached to the holder structure 4.

The subassemblies of the base core - base sleeve with the terminal pins 24 thereon and the lamp - support structure 4 are then loosely connected together, the current supply leads 27 being threaded into the terminal pins 24. The lamp is then placed into a test apparatus to properly align the filament of lamp 1 with the locating plate or ring 10. The lamp can be adjusted in three dimensions, up-down, right-left, and to-fro. When the lamp is properly adjusted, for appropriate light distribution from the filament with respect to the locating ring or plate 10, the laser weld L is carried out. Use of the laser ensures that, after welding, there will be no change in the position of the lamp with respect to the base sleeve since no forces are applied to the weld point during welding.

FIGS. 5 and 6 illustrate another embodiment of the invention. Lamp 1, again, is a 50 W halogen incandescent lamp of the type H7, replacing type H1. In general, halogen incandescent lamps can be used both as high-beam and low-beam lights, as well as combination lights in automotive head lamps. Similar parts have been given the same reference numeral and will not be explained again. Elements which have essentially the same function and shape are given the same reference numerals as in FIG. 1, with prime notation.

The sleeve 9' is inwardly engaged by the essentially apron-like structure 7 of the holding structure 4 which supports the lamp 1. The apron 7 and the sleeve 9' are connected, again by welding, and, for example, by spot-welding. The base sleeve 9' has the positioning ring 10 formed thereon, as in the embodiment of FIGS. 1 and 2, the ring 10 being formed with respective recesses, cutouts and projections 11. The ring 10 is in a plane transverse to the center line or longitudinal axis of the lamp.

In accordance with a feature of the invention, two oppositely located tabs 13' are formed on or secured to, preferably unitary with the base sleeve 9',to attach the base sleeve and the base core 17' together. Before assembly, the tabs 13' are aligned with the axis of the base sleeve 9', as shown in broken lines 13'' in FIGS. 5 and 6.

The base core 17', preferably of ceramic, for example Steatite, is slightly thinner than that described in connection with FIGS. 1 and 2; it is fitted into the base sleeve 9' from below and, essentially, has the form of a cylindrical structure with suitable apertures. It is recessed around the outside with two part-semicircular recesses 18 in order to provide room for the ends 8 of the apron-like support structure 7.

In accordance with a feature of the invention, the base core 17' is formed with a radially outwardly projecting rim 15' which forms an abutment surface for the base sleeve 9'at the end remote from the bulb. The rim 15' is interrupted in the region of the tabs 13'.

The base core 17 is formed with two elongated radially inwardly directed depressions 12' at the end surface 16', that is, the surface remote from the lamp 1. The depressions 12' provide room to receive the tabs 13' when they are bent inwardly, that is, by about 90° from the position 13''. The inner rim or edge of the depressions 12' is formed with a further inwardly extending recess portion 14' into which the ends 19' of the tabs 13' can be bent. This arrangement will result in a position of the tabs 13' which will not engage tightly or smoothly against the end surface 16' or, rather, the surface of the recess therein, but in a slightly convexly bowed position, as best seen in FIG. 5. This arrangement provides for a particularly good compensation of the tolerances which arise in ceramic base cores, which, in contrast to plastic base cores, are substantially higher.

The base core 17', additionally, is formed with two axial bores 20' in which metallic tubes forming circular pin terminals 21' are secured by riveting, by expanding the upper ends thereof. The pins 21' are formed with a circumferential bulge or ring 22' which is seated in a recess 23' to form an abutment surface for the pins against the surface of the base core remote from the bulb 1. Current supply leads 27, extending from the pinch seal 3, are angled off in the direction of the terminal pins 21' and threaded into the interior of the pins 21'. The interior diameter of the pins 21' preferably decreases to just above the diameter of the current supply leads 27. At the terminal ends, the current supply leads 27 are welded to the pins 21'.

The system also provides excellent protection against sprayed water, water immersion, contamination and the like by covering or coating the base with a layer of plastic, to seal the base, for example by an injection-molded plastic coating.

Another type of automotive head lamp, utilizing the base construction in accordance with the present invention is shown in FIGS. 7 and 8. The lamp is illustrated in greater detail to show the filament 32, positioned axially within the lamp, the lamp being of the type H7 and corresponding, for example, to the lamp 1 of FIGS. 1, 2, 5 and 6. The bulb 31 is made of hard glass. The pinch seal 33 of the bulb is resiliently clamped in a unitary substantially cup-shaped holder 34 made of a copper alloy. The bottom 35 of the cup, facing the bulb 31, has a double-T shaped slit in which the pinch seal 33 is fitted. Four bumps 36 projecting from the bottom 35 of the cup 34 provide for seating projections for four locating projections 30 formed laterally of the pinch seal 33 on the bulb. The side wall of the cup-shaped support element 34 is subdivided into three portions. The first one is a cylindrical portion 37, immediately adjacent the bottom 35 of the cup-shaped support element 34; it is approximately of the same diameter or just slightly larger than that of the bulb 31, and comparatively tightly surrounds the pinch seal 33. The subsequent section is a frusto-conical portion 38 which merges with a third, essentially cylindrical portion 39 having a diameter larger than that of the cylindrical portion 37. The cylindrical portion 39 is formed with circumferentially uniformly distributed projecting tabs 41, separated from each other by separating spaces of substantial circumferential extent, larger than the width of the projecting tabs 41.

The base sleeve 40 is formed as an axially directed hollow cylinder having a collar 43 which is bent over backward by about half its height towards the outside. The cylindrical portion 39 of the holder element is externally fitted around the collar 43 and welded thereto, as well known. The free end of the collar 43 is externally extended to form the locating or positioning ring 44, positioned about intermediate the axial height of the hollow cylinder formed by the base sleeve 40. The entire base sleeve 40, including the collar 43 and the positioning ring 44, is a single unitary element which is deformed from a single metallic piece in a metal forming and pressing operation.

The base sleeve 40 is so made that the attachment elements are easily accessible from the outside, and permit easy application of welds upon positioning of the lamp 31 with respect to the positioning ring 40. This eliminates openings or holes as in welding from the inside of the base sleeve. Any type of welding technology may be used, for example spot welding, resistance welding, or laser welding.

Welding which requires some engagement pressure of the individual parts to be welded together can still be carried out due to the particularly stable configuration of the base sleeve and the holding structure, which does not permit deformation of the lamp with respect to the positioning plate or ring 44 and consequently maladjustment of the lamp with respect thereto.

The end 49 of the hollow cylinder formed by the base sleeve 40 is bent slightly towards the inside and has, as in the other embodiments, projecting tabs 45 (FIG. 8) formed thereon which are bent over inwardly after assembly of the base core 48. The tabs 45 are seated in depressions 46 formed in the end surface 47 remote from the bulb 31 of the ceramic base core 48.

The bottom 46*a* of the depression 46 extends parallel to the end surface 47, as best seen in FIG. 8. This is not a requirement, however, and in another embodiment illustrated in FIG. 8*a*, the bottom 46*b* is slightly angled inwardly with respect to the end surface 47 of the base core, so that the tab 45' is bent by more than 90°. The hold is thereby improved. The end 49 remote from bulb 31 of the base sleeve is engaged by a radially externally projecting rim 50 on the base core 48, so that the base core 48 is tightly retained within the base sleeve 40, without play. Yet, tolerances in axial direction of the base core can readily be compensated, without leading to relative changes of position between the lamp 31 and the locating ring or plate 44. The base core, again, is constructed as an essentially solid cylindrical body, formed merely with suitable openings for the current supply terminals and current supply leads. Two current supply leads 51 extend outwardly from the lamp through the pinch seal 33. They are fitted through conically converging through-openings 54 of the base core 48, positioned close to the center axis thereof, and terminating at the end surface 47 remote from the lamp 31 for welding to weld eyes 55 of blade contacts 56.

The contacts 56 are flat punched elements, see FIGS. 9*a* and 9*b*, which are held in separate slits 57 formed in the otherwise essentially solid base core 48, and which are located close to the conically converging openings 54. The end surface 47 of the base core 48 is formed with two recesses 58, terminating adjacent the outlets of the conical openings 54 and common with an adjacent slit 57, to provide room for the welding eye 55 of the contact blade, the welding eye 55 being angled off by 90° with respect to the major plane of the contact blade, for engagement against the recess 58. At the end surface 59 of the base core 48, and adjacent the terminal end of the slits 57, an inclined surface 60 is left which rises towards the conical opening 54, see FIG. 7. The end 61 of the respective terminal blades 56, extending above the end surface 59, forms a narrow arc over the welding eye 55. This end 61 is slit in the middle. The lower side 63 of each half 62 of the arc is so shaped with an inclined surface that the height of the arc portion increases towards the middle of the contact blade, as seen in FIG. 9*a*. FIG. 9*a* illustrates the contact blade before insertion and deformation, as will appear. After insertion, the two halves 62 are twisted by a maximum of 90° in the direction towards the inclined surface 60, see arrow in FIG. 9*b* and twisted position in FIG. 7, for engagement against the surface 60. This arrangement ensures reliable attachment of the contact blades, without play, on the base core, even if the base core is made of non-yielding or ceramic material; further, it permits compensation for the large tolerances which can occur in ceramic elements. The inclined surface 60 on the base core 48, and twisting of the halves of the arced portions, together, permit compensation for such tolerances; the level of the engagement points of the respective halves of the terminal blades on the inclined surface will depend on the twist angle and can be varied individually to suit various dimensions of the base core, in dependence on the variation of the base core from a given design value. The contact blade, which has a counter bearing surface formed by the welding eye 55, is tightened into the base core 48 by the twist connection of the arced ends.

The embodiments illustrated permit a lamp base construction which is of minimum height, for example of about 62 mm. The arrangement of FIGS. 7, 8, especially, is compact and can be reduced by about 13 mm with respect to the prior art embodiments. These highly compact lamps are especially suitable for automotive application where the compact lamp construction permits overall headlight construction of minimum wind resistance. The short length of the lamp - base combination is made possible by optimized positioning of the respective elements of the base structure, including the holding element for the lamp as such. Use of ceramic base cores is particularly desirable since the thermal loading of ceramics is much higher than that of plastic material, so that the base core and the lamp can be placed closely together. The combination of the features of a rim formed on the base sleeve (FIGS. 1, 2) or on the base core (FIGS. 5–8) in cooperation with an abutment surface on the base core (FIGS. 1, 2) or on the base sleeve (FIGS. 5–8), respectively, provides for reliable seating, while retaining the adjusted positioning of the lamp with respect to the positioning or locating ring or plate formed on the base sleeve, with which the lamp and its support structure are attached. The substantial tolerances which occur when ceramics are used for the base core can be compensated in a simple and space-efficient manner while retaining the accuracy of positioning of the lamp with respect to the locating plate or ring.

Various changes and modifications may be made, and any features described herein may be used with any of the others, within the scope of the inventive concept.

We claim:

1. A cementless electric lamp (1, 31) and base combination in which the lamp comprises a single-ended bulb (1, 31) having a press seal (3, 33) at one end thereof, filaments (2, 32) located within the bulb, and current connection leads (27, 51) extending outwardly of the press seal; and the base comprises a metallic base sleeve (9, 40), a base core (17, 48) of insulating material, and terminal contact elements (24, 24', 56) electrically connected to said current connection leads (27, 51), and means (4, 7, 38) coupled to the bulb and secured to the base sleeve for attaching the bulb to the base sleeve, wherein the base sleeve (9, 40) is a hollow essentially cylindrical structure;

the base core (17, 48) is an apertured, essentially cylindrical solid structure dimensioned and shaped to fit into said hollow base sleeve, and defining an end surface (16', 47) remote from the lamp;

a rim (12, 15', 50) formed on one of said structures and in engagement with an end portion of the other of said structures; and projecting tabs (13, 13', 45) formed on said sleeve and bent by about 90° and extending at least in part transversely to the longitudinal axis (CL) of the lamp and over part of the end surface (16', 47); and wherein said rim and said projecting tabs are, respectively, positioned to lock the base core into the base sleeve and hence lock the base core and the base sleeve together without play.

2. The lamp of claim 1, wherein the rim (12) is formed on said base sleeve (9, 40) and forms an inwardly bent collar portion (12);

said projecting tabs being bent by about 90° with respect to said rim and extending essentially parallel to said lamp axis inwardly of the base core;

said base core being formed with through-slits (20) to receive the inwardly bent tabs (13); and wherein said tabs (13) are deformed to lock the tabs in position with respect to the base core.

3. The lamp of claim 2, wherein the base core is formed with recess surfaces (21) adjacent the slits (20), and located at a region of the base core close to the lamp (1);

and wherein the deformed portions (14) of the tabs are twisted portions located in the regions of the recesses (21).

4. The lamp of claim 2, wherein the ends (14) of the tabs are formed with at least one barb (16), the barbs engaging a surface (21) of the base core.

5. The lamp of claim 1, wherein the base core (17, 48) comprises a ceramic.

6. The lamp of claim 2, wherein the base core is formed with a circumferential groove (19) in which the inwardly extending rim or collar (12) of the base sleeve is fitted.

7. The lamp of claim 1, wherein the base core is formed with oppositely positioned, part-semicircular recesses (18) at the circumference thereof;

and end portions (8) of said clamping and securing means are received in said recesses (18).

8. The lamp of claim 1, wherein said terminal contact elements are pins (24) of essentially circular diameter;

and the base core (17, 48) is formed with openings (23) dimensioned and shaped to receive said pins (24).

9. The lamp of claim 1, wherein the base core (17, 48) is formed with said rim projecting radially outwardly;

and wherein the tabs (13') are bent inwardly toward and over part of the end surface (16, 47) of the base core.

10. The lamp of claim 9, wherein the base core is formed with depressions (12', 46) at said end surface (16', 47) to receive the projecting tabs therein which are bent over the end surface.

11. The lamp of claim 9, wherein said end surface is formed with an inwardly extending pocket (14') to receive an end portion (19') of the tab (13').

12. The lamp of claim 9, wherein the tabs (13') are convexly bent with respect to the end surface (16').

13. The lamp of claim 9, wherein the end surface (47) is formed with an inclined inwardly directed surface portion (**46*b*), and the tab (45'**) is bent over by more than 90° to fit into said inwardly inclined surface portion.

14. The lamp of claim 1, wherein the base sleeve is formed with two oppositely positioned tabs (13, 45).

15. The lamp of claim 1, wherein the end surface (59) of the base core (48)

facing the lamp (31) is formed with inclined surfaces (60);

the terminal contact elements comprise flat portions (56);

the base core (48) is formed with longitudinal slits (57) to receive said flat portions, the flat portions of the terminal elements being formed with bent-over attachment eyes (55) engaging against an end surface portion of the base core remote from the lamp;

and wherein the end portions (61) of the terminal contact elements extend over the end surface close to the lamp of the base core, and are bent thereover in the region of the inclined surfaces (60) to provide a clamping connection due to said bent-over portions and the attachment eyes.

16. The lamp of claim 1, wherein the base sleeve (40) is formed with an outwardly reentrant bent collar (43) at the side adjacent the lamp;

and a locating or positioning ring or plate (44) radially extending from said collar and unitary therewith.

17. The lamp of claim 16, wherein the bulb clamping and securing means comprises a cup-shaped holder (34) surrounding the pinch or press seal (33) of the lamp, said cup-shaped holder terminating in an essentially cylindrical portion in engagement with said collar (43);

and weld connections connecting the collar (43) and said cylindrical portion.

18. The lamp of claim 1, wherein said base sleeve (9, 40) includes a plate-like extension (10, 40) projecting transversely to the lamp axis (CL) to form an optical locating projection;

and wherein said tabs (13, 13',48) are integral with said sleeve and deformed therefrom to compensate, upon engagement with the base core, for tolerances in the dimension of the base core while maintaining the position of the lamp with respect to said plate-like extension (10, 40).

19. An automotive-type halogen incandescent lamp, particularly adapted for association with an optical system, such as a reflector, said lamp comprising the combination of a single-ended bulb (1, 31) having a press seal (3, 33) at one end thereof;

filaments (2, 32) in said bulb, and contact connection leads (27, 51) extending outwardly of said press seal;

and a base, said base comprising a metallic base sleeve (9, 40), a plate-like locating extension or ring (10) projecting transversely from the base sleeve and to form an optical locating and positioning projection;

a base core (17, 48) of ceramic material;

terminal contact elements (24, 56) electrically connected to said current connection leads; and means (4, 7, 34) clamping the bulb and secured to the base sleeve for attaching the bulb to the base sleeve and hence coupling the bulb in predetermined position with respect to said locating ring, wherein the base sleeve (9, 40) is a hollow, essentially cylindrical structure;

the base core (17, 48) is an apertured, essentially cylindrical solid structure dimensioned and shaped to fit into said hollow base sleeve, and defining an end surface (16', 47) remote from the lamp;

a rim (12, 15', 50) formed on one of said structures and in engagement with an end portion of the other of said structures; and projecting tabs (13, 13', 45) formed on said sleeve and bent by about 90° and extending at least in part transversely to the longitudinal axis (CL) of the lamp and over part of the end surface (16', 47); and wherein said rim and said projecting tabs are, respectively, positioned to lock the base core into the base sleeve and hence lock the base core and the base sleeve together without play.

20. The lamp of claim 19, wherein the base core (17) is formed with internally extending longitudinal slits (20) and engagement surfaces (21) adjacent the termination of said slits at the side of the base core close to the lamp;

and wherein said tabs (13) extend inwardly and into and through said slits, projecting beyond said engagement surfaces (21), said tabs being deformed at the end regions (14) thereof in the region of said engagement surfaces by twisting said end regions.

21. The lamp of claim 20, wherein the end portions (14) of the tabs (13) are split to form barbs projecting from the end portions of the tabs, the barbs engaging against the engagement surfaces (21).

* * * * *